US005637430A

United States Patent [19]

Shimizu et al.

[11] Patent Number: 5,637,430

[45] Date of Patent: Jun. 10, 1997

[54] NONMAGNETIC ONE-COMPONENT TONER

[75] Inventors: Jun Shimizu; Shin-ichi Sata; Yasuhiro Hidaka; Masayuki Maruta, all of Wakayama, Japan

[73] Assignee: Kao Corporation, Tokyo, Japan

[21] Appl. No.: 654,909

[22] Filed: May 29, 1996

[30] Foreign Application Priority Data

May 29, 1995 [JP] Japan ..... 7-155399

[51] Int. Cl.[6] ..... G03G 9/09; G03G 9/097

[52] U.S. Cl. ..... 430/106; 430/110; 430/903

[58] Field of Search ..... 430/106, 110, 430/903

[56] References Cited

U.S. PATENT DOCUMENTS

| | | | |
|---|---|---|---|
| 3,590,000 | 6/1971 | Palermiti | 430/110 |
| 4,246,332 | 1/1981 | Tanaka et al. | 430/109 |
| 4,623,606 | 11/1986 | Ciccarelli | 430/110 |
| 4,624,907 | 11/1986 | Niimura et al. | 430/106 |
| 4,657,837 | 4/1987 | Morita et al. | 430/109 |
| 4,917,982 | 4/1990 | Tomono et al. | 430/99 |
| 5,391,695 | 2/1995 | Kawabe et al. | 430/109 |
| 5,439,770 | 8/1995 | Taya et al. | 430/106 |
| 5,483,327 | 1/1996 | Taya et al. | 430/110 |
| 5,508,139 | 4/1996 | Tanaka et al. | 430/110 |

FOREIGN PATENT DOCUMENTS

| | | |
|---|---|---|
| 49-006931 | 1/1974 | Japan . |
| 50-028840 | 3/1975 | Japan . |
| 50-044836 | 4/1975 | Japan . |
| 50-081342 | 7/1975 | Japan . |
| 56-116043 | 9/1981 | Japan . |
| 57-060339 | 4/1982 | Japan . |
| 57-109875 | 7/1982 | Japan . |
| 59-045453 | 3/1984 | Japan . |
| 63-279265 | 11/1988 | Japan . |
| 1156759 | 6/1989 | Japan . |
| 2000881 | 1/1990 | Japan . |
| 2005073 | 1/1990 | Japan . |
| 2029664 | 1/1990 | Japan . |
| 2161464 | 6/1990 | Japan . |
| 4142301 | 5/1992 | Japan . |

*Primary Examiner*—Roland Martin

[57] ABSTRACT

The nonmagnetic one-component toner is usable in a developer device including a developer roller and a blade, the blade serving to regulate a toner layer formed on the developer roller into a uniform thickness and to supply electric charges to the toner by triboelectric charging, and the nonmagnetic one-component toner includes at least a binder resin, a colorant, and an iron compound. Here, the binder resin includes a polyester resin as a main component, and the iron compound has the general formula (I) and is contained in an amount of between 0.1 parts by weight or more and less than 1.0 part by weight, based on 100 parts by weight of the binder resin.

6 Claims, No Drawings

NONMAGNETIC ONE-COMPONENT TONER

BACKGROUND OF THE INVENTION

1. Field of the Invention

The present invention relates to a nonmagnetic one-component toner, a kind of toner for electrophotography used for development of electrostatic latent images in electrophotography, electrostatic recordings, and electrostatic printing.

2. Discussion of the Related Art

As disclosed in U.S. Pat. Nos. 2,221,776, 2,297,691 and 2,357,809 and other publications, conventional electrophotography utilized in apparatuses for forming fixed images, such as laser printers and dry-type electrostatic copy machines, comprises the steps of forming an electrostatic latent image by evenly charging a photoconductive insulating layer (a charging process) and subsequently exposing the layer to eliminate the charge on the exposed portion (an exposing process) and visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process). This electrophotography may further comprise, subsequent to the transferring of the visible image, scraping off residual toner on the photoconductor for the purpose of cleaning the photoconductor surface (a cleaning process).

In the developing process of the above electrophographic methods, there have been proposed as the most convenient method two-component magnetic brush developing methods using a developer consisting of two components, namely, a toner and a carrier, the carrier being used for the purposes of supplying electric charges to the toner and for conveying the charged toner onto the latent image portion by a magnetic force.

However, in the two-component magnetic brush developing method, since a magnetic force is utilized in the conveying of the developer, a magnet has to be placed in the developer roller, and the carrier is made of a metal or an oxide thereof such as iron powder, nickel powder, and ferrite. Therefore, the developer device and the developer become undesirably heavy, thereby making it difficult to miniaturize and thus reduce the weight of the overall recording device.

On the other hand, as disclosed in U.S. Pat. Nos. 3,909,258 and 4,121,931, there have been conventional well used magnetic one-component developing methods comprising the step of conveying a toner to the latent image portion without using a carrier, the methods being carried out by utilizing a magnetic force owned by the toner containing a magnetic substance therein. However, a magnet has to be also used in the inner portion of the developer roll in this developing method, making it difficult to reduce the weight of the developer device.

In order to solve the problems in these developing methods, much studies have been recently conducted on nonmagnetic one-component developing methods wherein a toner alone is used without containing any magnetic powder, as disclosed, for instance, in U.S. Pat. Nos. 2,895,847 and 3,152,012, and Japanese Patent Examined Publication Nos. 41-9475, 45-2877 and 54-3624.

However, in the conventional nonmagnetic one-component developing methods, since toners are provided with electric charges only at an instant when the toner passes near the charging blade, the charging control of the toner in these methods is extremely difficult. In order to solve this problem, there have been proposed a method in which a silica fine powder subjected to a surface-treatment with a titanate coupling agent is added to the surface of the toners (see, for instance, Japanese Patent Laid-Open No. 59-231549). On the other hand, it is also important to improve the contact efficiency of the toner with the charging blade. In order to achieve good contact efficiency, various external additives have been studied, as disclosed, for instance, in Japanese Patent Laid-Open Nos. 64-77075, 3-294864, etc. Further, for the purpose of solving the problem of poor charging of small toners passing besides large toners, a particle size distribution has been also studied as disclosed, for instance, in Japanese Patent Laid-Open No. 63-279261.

However, the above developing methods alone do not provide sufficient charge control, and particularly there are problems in nonmagnetic one-component developing, so that improvements in background level cannot be sufficiently found.

Also, in order to keep the charges on the toner, the triboelectric properties owned by a resin constituting the main component of a toner can be utilized. However, the triboelectric properties of the toner are small in this method, so that the background level of the visible images is liable to be increased during development, and thereby unclear fixed images are liable to be formed. Therefore, in order to give desired triboelectric properties to the resulting toners, addition of dyes or pigments and further, charge control agents, has been proposed for the purpose of controlling triboelectric properties.

However, in the above methods, although toners may provide good fixed images in the beginning, since the developer roller and toner carriers such as carriers are liable to be contaminated during repeated copying and supplying of the toner, such problems arise, that the background level increases and that the image density decreases. One type charge control agent has low triboelectric charges and is more liable to be affected by environmental conditions such as temperature and humidity, so that changes in environmental conditions cause changes in image density in the resulting toners. Another type of charge control agent has poor dispersibility in the resin, so that the triboelectric charges between the particles in the resulting toner are likely to be uneven, thereby making it liable to cause increase in the background level. Still another types of charge control agent has poor storage stability, so that the triboelectric charges of the resulting toner are liable to be lowered during long-term storage.

In order to solve these problems, Japanese Patent Examined Publication Nos. 43-17955, 55-42752, and 53-1994 disclose the use of various metal complexes as negative charge control agents. Although these charge control agents certainly show excellent triboelectric charges, these compounds are chromium-based, and therefore much improvement is desired from the aspect of safety.

In view of the above, Japanese Patent Laid-Open Nos. 61-155464, 61-101558, and 61-155463 disclose the use of iron complexes (iron compounds) as charge control agents. These publications disclose that the iron complexes give excellent negative chargeability in the resulting toner and have excellent compatibility with the resin. However, these publications do not specifically disclose a toner obtainable by using a polyester, as a main component, as mentioned below, and mere use of these iron complexes for a nonmagnetic one-component toner does not altogether solve the problems concerning the background levels mentioned above for the reasons given below. The nonmagnetic one-component developing method is completely different from other kinds of developing methods in the steps of conveying and charging the toner. Also, depending upon the binder resins used, the compatibility of the iron complexes with the binder resin and the triboelectric properties in the nonmagnetic one-component developing method notably change. Therefore, it has been difficult to select a resin suitable for a nonmagnetic one-component toner and types and amounts of iron complexes.

On the other hand, as for binder resin for toners, various resins, including styrenic copolymers, such as polystyrenes, styrene-butadiene copolymers, and styrene-acrylic acid copolymers; ethylenic copolymers, such as polyethylenes and ethylene-vinyl acetate copolymers; poly(meth)acrylic acid esters; polyester resins; epoxy resins; and polyamide resins, have been used. Among these resins, the polyester resins are particularly used as resins for toners having excellent low-temperature fixing ability. Also, the polyester resins inherently have good resin toughness, so that the durability of the resin can be improved while retaining the low-temperature fixing ability, and thus making them suitable for nonmagnetic one-component toner wherein a stress is more likely to be exerted to a toner by a charging blade.

Therefore, particularly in a nonmagnetic one-component toner using polyester resins, the development of a toner with sufficient charge control in order to make the background level low is in demand in the art.

SUMMARY OF THE INVENTION

Accordingly, an object of the present invention is to provide a nonmagnetic one-component toner with sufficient charge control which results in a remarkably low background level in a such a toner containing at a main component of the binder resin, a polyester resin.

As a result of intensive research in view of the above problems, in the case where a polyester is used as a binder resin suitable for a nonmagnetic one-component toner, the present inventors have studied the types and amounts of the iron complexes used and found the following:

Conventionally, the charge control agent is generally added in the toner in an amount of from 1 to 5 parts by weight, based on 100 parts by weight of the binder resin. For instance, in a toner obtainable by using a styrene-acrylic acid resin which is generally used as a binder resin, the amount of the charge control agent is usually 2 parts by weight or more, and in the case where a toner is obtainable by using a polyester resin as a binder resin, particularly in the case of negatively chargeable toners, since the negative chargeability of the resin is extremely strong, the amount of the charge control agent is generally from 1 to 2 parts by weight. However, when a particular iron complex is chosen for testing, it is found that the background level is undesirably increased in the case of a nonmagnetic one-component toner containing the iron complex in an amount in the above-mentioned ranges. Although the decrease in the amount of the charge control agent has not conventionally thought to directly cause a decrease in the background level, the present inventors have found for the first time that by adding a particular charge control agent to the polyester resin in an amount notably lower than that conventionally added, the background level can be extremely decreased to an extent unexpected from the conventional toners.

Specifically, the present invention is concerned with the following:

(1) A nonmagnetic one-component toner usable in a developer device comprising a developer roller and a blade, the blade serving to regulate a toner layer formed on the developer roller into a uniform thickness and to supply electric charges to the toner by triboelectric charging, the nonmagnetic one-component toner comprising at least a binder resin, a colorant, and an iron compound, wherein the binder resin comprises a polyester resin as a main component, and wherein the iron compound has the following general formula (I):

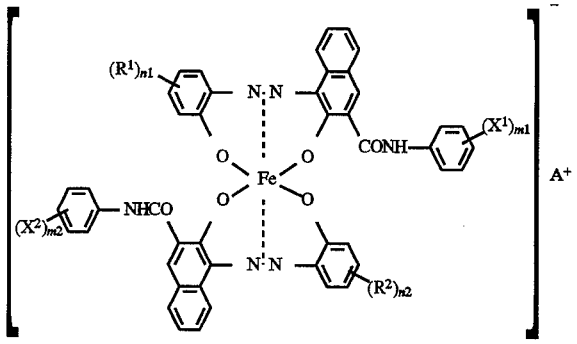

wherein $R^1$ and $R^2$ independently stand for a hydrogen atom, an alkyl group having 1 to 18 carbon atoms, an alkenyl group having 2 to 18 carbon atoms, a sulfonamide group, a methanesulfonyl group, a sulfonic acid group, a carboxyester group, a hydroxyl group, an alkoxy group having 1 to 18 carbon atoms, an acetylamino group, a benzoylamino group, or a halogen atom, and $R^1$ and $R^2$ may be identical or different; n1 and n2 each stands for an integer of 1 to 3; $X^1$ and $X^2$ independently stand for a hydrogen atom, an alkyl group having 1 to 18 carbon atoms, an alkoxy group having 1 to 18 carbon atoms, a nitro group, or a halogen atom, and $X^1$ and $X^2$ may be identical or different; m1 and m2 each stands for an integer of 1 to 3; and A stands for a hydrogen ion, a sodium ion, a potassium ion, an ammonium ion, or mixtures thereof, and is contained in an amount of between 0.1 parts by weight or more and less than 1.0 part by weight, based on 100 parts by weight of the binder resin;

(2) The nonmagnetic one-component toner described in item (1) above, wherein the polyester resin has an OHV/AV value of 1.2 or more when an acid value is defined as AV and a hydroxyl value is defined as OHV;

(3) The nonmagnetic one-component toner described in item (1) or item (2) above, wherein the polyester resin is obtainable by condensation polymerization between:

(a) a diol component represented by the following general formula (II):

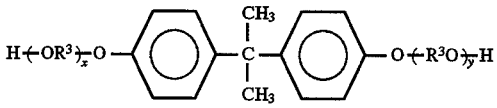

wherein $R^3$ stands for an alkylene group having 2 to 4 carbon atoms; and x and y independently stand for positive integers with an average sum of 2 to 16; and (b) an acid component comprising:

(i) 1 to 50 mol % of a dicarboxylic acid represented by general formulas (III) or (IV):

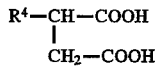

(III)

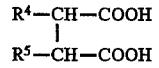

(IV)

wherein $R^4$ and $R^5$ independently represent a saturated or unsaturated hydrocarbon group having 4 to 20 carbon atoms, or an acid anhydride thereof; and (ii) 10 to 30 mol % of trimellitic acid or an acid anhydride thereof;

(4) The nonmagnetic one-component toner described in any one of items (1) to (3) above, wherein the polyester resin has a glass transition temperature of 55° C. or more;

(5) The nonmagnetic one-component toner described in any one of items (1) to (4) above, wherein the iron compound having the general formula (I) has a dispersed particle size of 1.0 μm or less; and (6) The nonmagnetic one-component toner described in any one of items (1) to (5) above, wherein the iron compound has the general formula (I), wherein $R^1$ and $R^2$ are both chlorine atoms, n1 and n2 are both equal to 1, $X^1$ and $X^2$ are both hydrogen atoms, and wherein "A" is a hydrogen ion, a sodium ion, an ammonium ion, or mixtures thereof.

DETAILED DESCRIPTION OF THE INVENTION

The nonmagnetic one-component toner of the present invention is suitably used for a developer device having a developer roller and a blade, the blade serving to regulate a toner layer formed on the developer roller into a uniform thickness and to supply electric charges to the toner by triboelectric charging, the nonmagnetic one-component toner comprising at least a binder resin, a colorant, and a charge control agent.

The charge control agents usable in the present invention are iron compounds having the general formula

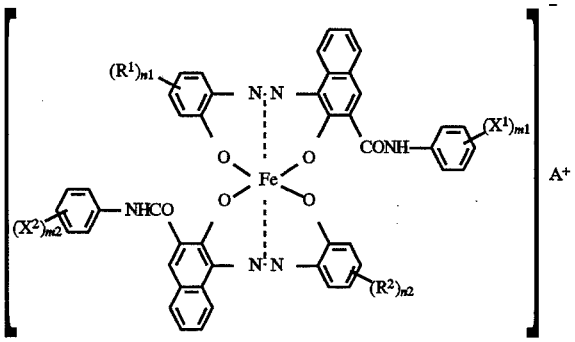

(I)

wherein $R^1$ and $R^2$ independently stand for a hydrogen atom, an alkyl group having 1 to 18 carbon atoms, an alkenyl group having 2 to 18 carbon atoms, a sulfonamide group, a methanesulfonyl group, a sulfonic acid group, a carboxyester group, a hydroxyl group, an alkoxy group having 1 to 18 carbon atoms, an acetylamino group, a benzoylamino group, or a halogen atom, and $R^1$ and $R^2$ may be identical or different; n1 and n2 each stands for an integer of 1 to 3; $X^1$ and $X^2$ independently stand for a hydrogen atom, an alkyl group having 1 to 18 carbon atoms, an alkoxy group having 1 to 18 carbon atoms, a nitro group, or a halogen atom, and $X^1$ and $X^2$ may be identical or different; m1 and m2 each stands for an integer of 1 to 3; and A stands for a hydrogen ion, a sodium ion, a potassium ion, an ammonium ion, or mixtures thereof.

The methods for producing the above iron compounds are described in detail, for instance, in Japanese Patent Laid-Open No. 61-155464, and the iron compounds are easily prepared according to the methods disclosed therein, whose disclosure is incorporated herein by reference. Alternatively, commercially available products, for instance, "T-77" (manufactured by Hodogaya Chemical Co., Ltd.), may be used. Among the above iron compounds, a preference is given to the iron compound "T-77" which has the above general formula (I), wherein $R^1$ and $R^2$ are both chlorine atoms, n1 and n2 are both equal to 1, $X^1$ and $X^2$ are both hydrogen atoms, and wherein "A" is a hydrogen ion, a sodium ion, an ammonium ion, or mixtures thereof.

The above iron compound is normally used in an amount of 0.1 parts by weight or more and less than 1.0 part by weight, preferably 0.3 parts by weight or more and less than 0.7 parts by weight, based on 100 parts by weight of the binder resin. However, in the case where a polyester resin is used as a main component of the binder resin, when the amount of the iron compound is 1.0 part by weight or more, the background level is liable to be drastically increased, and when the amount of the iron compound is less than 0.1 parts by weight, sufficient effects of the charge control agents cannot be achieved.

In the present invention, the iron compounds which are contained in toners have a dispersed particle size of preferably 1.0 μm or less, more preferably 0.5 μm or less. When the dispersed particle size exceeds 1.0 μm, the iron compounds become easily detached from the formed toners and contaminate the developer roller and other members of the developer device, thereby undesirably causing such problems as image defects. Here, the term "dispersed particle size" (dispersion unit) of the iron compounds refers to an outer diameter of aggregates when the iron compounds are present in the form of aggregates, the dispersed particle size being measured by taking a cross-sectional observation using an electron microscope. Incidentally, the dispersed particle size is easily controlled by adjusting the kneading conditions for preparing the toners.

As for the binder resins, polyesters which are suitable components for binder resins for nonmagnetic one-component toners are used as a main component. Here, "a main component" means that the polyester resin is contained in an amount of from 60 to 100% by weight, preferably 80 to 100% by weight, of the binder resin. In the polyester resins, a carboxyl group and/or a hydroxyl group remains at the terminus of the polyester molecules unless the terminal groups of the polyester molecules are subjected to a trans-esterification reaction or treated with monohydric alcohols and/or monocarboxylic acids. It is confirmed that the amount of triboelectric charges of the polyester resins themselves greatly changes depending upon the amount of the terminal groups remaining in the polyester molecules. In other words, as for the amounts of the terminal groups, when the acid value (AV) is lowered too much, the polyester resins have decreased triboelectric charges, and when the acid value is increased too excessively, the environmental reliability after the toner production becomes notably poor, thereby making it impractical to be used for toners though the triboelectric charges of the polyester resins are increased to a certain level.

For the reasons given above, the polyester resins having acid values of from 5 to 60 KOH mg/g are generally used for toners. Also, the usable polyester resin preferably has an OHV/AV value of 1.2 or higher, wherein the "AV" refers to an acid value which is expressed by the units of KOH mg/g and the "OHV" refers to an hydroxyl value which is expressed by the units of KOH mg/g. When a polyester resin has an OHV/AV value of 1.2 or higher, fluidity becomes good, thereby making it possible to lower the lowest fixing temperature. Incidentally, the AV and the OHV are measured by the method according to JIS K 0070, and in the case where the component insoluble to ethyl acetate is 3.0% by weight or more, the solvent used for the acid value measurement is desirably dioxane. In order to adjust the OHV/AV value to 1.2 or higher, the number of functional groups of the entire alcohol components larger than those of the entire carboxylic acid components should be used in the co-condensation polymerization reactions between alcohol components and carboxylic acid components, thereby the OHV/AV values of 1.2 or higher can be obtained (Japanese Patent Laid-Open No. 62-195677, 62-195678, 63-68849, 63-68850, 63-163469, and 1-155362).

The polyester resins usable in the present invention can be obtained by the condensation polymerization of starting material monomers, namely the condensation polymerization between an alcohol and a carboxylic acid, a carboxylic acid anhydride or a carboxylic acid ester.

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A and other dihydric alcohol components.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol components.

Examples of the dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkylsuccinic acids or alkenylsuccinic acids, such as n-dodecylsuccinic acid, n-dodecenylsuccinic acid, and isooctenylsuccinic acid, acid anhydrides thereof, lower alkyl esters thereof, and other dicarboxylic acid components.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof, lower alkyl esters thereof, and other tricarboxylic or higher polycarboxylic acid components.

In the present invention, the following polyester resin is even more preferably used from the viewpoint of satisfying both the low-temperature fixing ability and the offset resistance, when a polyester resin is obtainable by condensation polymerization between:

(a) a diol component represented by the following general formula (II):

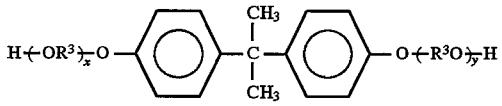

(II)

wherein $R^3$ stands for an alkylene group having 2 to 4 carbon atoms; and x and y independently stand for positive integers with an average sum of 2 to 16; and (b) an acid component comprising:

(i) 1 to 50 mol % of a dicarboxylic acid represented by general formulas (III) or (IV):

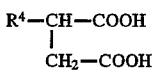

(III)

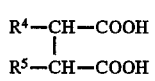

(IV)

wherein $R^4$ and $R^5$ independently represent a saturated or unsaturated hydrocarbon group having 4 to 20 carbon atoms, or an acid anhydride thereof; and (ii) 10 to 30 mol % of trimellitic acid or an acid anhydride thereof.

In the present invention, the usable polyester resin preferably has a glass transition temperature of preferably 55° C. or more, more preferably 60° C. or more. In the development of the nonmagnetic one-component, since tremendous amount of stress is exerted on the toners by the charging blade, the durability against stress cannot be sufficiently attained when the glass transition temperature is less than 55° C.

The polyester resins usable in the present invention can be produced by carrying out condensation polymerization between a polyol component and a polycarboxylic acid component at a temperature of from 180° to 250° C. in an inert gas atmosphere. In order to accelerate the condensation polymerization, conventionally used esterification catalysts, such as zinc oxide, stannous oxide, dibutyltin oxide, and dibutyltin dilaurate, may be added to the above components.

In the preparation of the toner of the present invention, besides the colorants, waxes and other additives may be added when necessary.

Examples of colorants used in the present invention include carbon black; inorganic pigments, such as iron black; acetoacetic arylamide-based monoazo yellow pigments, such as C.I. Pigment Yellow 1, C.I. Pigment Yellow 3, C.I. Pigment Yellow 74, C.I. Pigment Yellow 97, and C.I. Pigment Yellow 98; acetoacetic arylamide-based bisazo yellow pigments, such as C.I. Pigment Yellow 12, C.I. Pigment Yellow 13, C.I. Pigment Yellow 14, and C.I Pigment Yellow 17; yellow dyes, such as C.I. Solvent Yellow 19, C.I. Solvent Yellow 77, C.I. Solvent Yellow 79, and C.I. Disperse Yellow 164; red or crimson pigments, such as C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Red 122, and C.I. Pigment Red 5; red dyes, such as C.I. Solvent Red 49, C.I. Solvent Red 52, C.I Solvent Red 58, and C.I. Solvent Red 8; blue pigments and dyes of copper phthalocyanine, such as C.I. Pigment Blue 15:3, and derivatives thereof; green pigments, such as C.I. Pigment Green 7 and C.I. Pigment Green 36 (Phthalocyanine Green). These pigments or dyes may be used alone or in combination. These pigments or dyes are preferably added in an amount of from about 1 to 15 parts by weight, based on 100 parts by weight of the binder resin.

Further, in the production of the toners, property improvers, for instance, offset inhibitors including waxes, such as polyolefins, may be also added. When the binder resin described above is used for the production of the toners in the present invention, these property improvers may not be necessary. Even if they are used, they are added in a small amount.

The toners of the present invention can be obtained by the steps of uniformly dispersing the above starting materials, a colorant, a charge control agent, and in certain cases, property improvers, and melt-kneading, cooling, pulverizing, and then classifying by known methods. Further, fluidizing agents, such as hydrophobic silica, may be externally added. The resulting toner has an average particle size of about 5 to 15 μm.

The nonmagnetic one-component toner of the present invention shows good triboelectric properties owing to the blade with a low background level, so that substantially no image defects such as an increase in background level and decrease in image density are observed even after making large number of copies.

EXAMPLES

The present invention is hereinafter described in more detail by means of the following resin production example, examples, and comparative examples, without intending to limit the scope of the present invention thereto.

In the present invention, the glass transition temperature (Tg) of the resin was measured by a differential scanning calorimeter under the following conditions.

Specifically, the glass transition temperature refers to the temperature of an intersection of the extension of the base-line of not more than the glass transition temperature and the tangential line showing the maximum inclination between the kickoff of the peak and the top thereof as determined with a sample using a differential scanning calorimeter ("DSC Model 210," manufactured by Seiko Instruments, Inc.), at a heating rate of 10° C./min. The sample is treated before measurement using the DSC by raising its temperature to 100° C., keeping at 100° C. for 3 minutes, and cooling the hot sample at a cooling rate of 10° C./min. to room temperature.

Resin Production Example 1

Seven-hundred and fourteen grams of polyoxypropylene (2.2)-2,2-bis(4-hydroxyphenyl)propane, 663 g of polyoxyethylene(2.2)-2,2-bis(4-hydroxyphenyl)-propane, 518 g of isophthalic acid, 70 g of isooctenylsuccinic acid, 80 g of 1,2,4-benzenetricarboxylic acid, and 2 g of dibutyltin oxide were placed in a three-liter four-neck glass flask equipped with a thermometer, a stainless steel stirring rod, a reflux condenser, and a nitrogen inlet tube. The contents were allowed to react with one another at 210° C. in a mantle heater in a nitrogen gas stream while stirring the contents.

The degree of polymerization was monitored from a softening point measured by the method according to ASTM E 28–67, and the reaction was terminated when the softening point reached 130° C.

The resulting resin was a pale yellow solid whose glass transition temperature was 65° C. Also, the resin had an acid value (AV) of 18 KOH mg/g and a hydroxyl value (OHV) of 35 KOH mg/g (OHV/AV=1.94). This resin is referred to as "Binder Resin (1)."

EXAMPLE 1

| | | |
|---|---|---|
| Binder Resin (1) | 100 | parts by weight |
| Carbon Black "REGAL 330R" (Manufactured by Cabot Corporation) | 8 | parts by weight |
| Charge Control Agent (Iron Compound Having the General Formula (I)) "T-77" (Manufactured by Hodogaya Chemical Co., Ltd.) | 0.4 | parts by weight |
| Low-Molecular Weight Polypropylene Wax "VISCOL 550P" (Manufactured by Sanyo Chemical Industries, Ltd.) | 2 | parts by weight |

The starting materials in the above proportions were blended well using a Henschel mixer, and then the mixture was kneaded using a twin-screw extruder. The resulting mixture was cooled and then roughly pulverized, and the roughly pulverized mixture was finely pulverized using a Jet mill. Further, the resulting finely pulverized powder was classified using an air classifier, to give an untreated toner having an average particle size of 10 μm.

To 1000 g of the untreated toner, 3 g of a hydrophobic silica "AEROZIL R-972" (manufactured by Nippon Aerozil Ltd.) was added to mix and adhere the hydrophobic silica to the toner surface using a Henschel mixer, to give Toner 1 according to the present invention.

Incidentally, the iron compound had a dispersed particle size in the toner of 0.2 μm.

EXAMPLE 2

| | | |
|---|---|---|
| Binder Resin (1) | 100 | parts by weight |
| Carbon Black "REGAL 330R" (Manufactured by Cabot Corporation) | 8 | parts by weight |
| Charge Control Agent (Iron Compound Having the General Formula (I)) "T-77" (Manufactured by Hodogaya Chemical Co., Ltd.) | 0.6 | parts by weight |
| Low-Molecular Weight Polypropylene Wax "VISCOL 550P" (Manufactured by Sanyo Chemical Industries, Ltd.) | 2 | parts by weight |

The starting materials in the above proportions were blended well using a Henschel mixer, and then the mixture was kneaded using a twin-screw extruder. The resulting mixture was cooled and then roughly pulverized, and the roughly pulverized mixture was finely pulverized using a jet mill. Further, the resulting finely pulverized powder was classified using an air classifier, to give an untreated toner having an average particle size of 10 μm.

To 1000 g of the untreated toner, 3 g of a hydrophobic silica "AEROZIL R-972" (manufactured by Nippon Aerozil Ltd.) was added to mix and adhere the hydrophobic silica to the toner surface using a Henschel mixer, to give Toner 2 according to the present invention.

Incidentally, the iron compound had a dispersed particle size in the toner of 0.3 μm.

COMPARATIVE EXAMPLE 1

| | | |
|---|---|---|
| Binder Resin (1) | 100 | parts by weight |
| Carbon Black "REGAL 330R" | 8 | parts by |

-continued

| | | |
|---|---|---|
| (Manufactured by Cabot Corporation) | | weight |
| Low-Molecular Weight Polypropylene Wax "VISCOL 550P" (Manufactured by Sanyo Chemical Industries, Ltd.) | 2 | parts by weight |

The starting materials in the above proportions were blended well using a Henschel mixer, and then the mixture was kneaded using a twin-screw extruder. The resulting mixture was cooled and then roughly pulverized, and the roughly pulverized mixture was finely pulverized using a jet mill. Further, the resulting finely pulverized powder was classified using an air classifier, to give an untreated toner having an average particle size of 10 μm.

To 1000 g of the untreated toner, 3 g of a hydrophobic silica "AEROZIL R-972" (manufactured by Nippon Aerozil Ltd.) was added to mix and adhere the hydrophobic silica to the toner surface using a Henschel mixer, to give Comparative Toner 1.

Comparative Example 2

| | | |
|---|---|---|
| Binder Resin (1) | 100 | parts by weight |
| Carbon Black "REGAL 330R" (Manufactured by Cabot Corporation) | 8 | parts by weight |
| Charge Control Agent (Iron Compound Having the General Formula (I)) "T-77" (Manufactured by Hodogaya Chemical Co., Ltd.) | 2 | parts by weight |
| Low-Molecular Weight Polypropylene Wax "VISCOL 550P" (Manufactured by Sanyo Chemical Industries, Ltd.) | 2 | parts by weight |

The starting materials in the above proportions were blended well using a Henschel mixer, and then the mixture was kneaded using a twin-screw extruder. The resulting mixture was cooled and then roughly pulverized, and the roughly pulverized mixture was finely pulverized using a jet mill. Further, the resulting finely pulverized powder was classified using an air classifier, to Give an untreated toner having an average particle size of 10 μm.

To 1000 g of the untreated toner, 3 g of a hydrophobic silica "AEROZIL R-972" (manufactured by Nippon Aerozil Ltd.) was added to mix and adhere the hydrophobic silica to the toner surface using a Henschel mixer, to give Comparative Toner 2.

Incidentally, the iron compound had a dispersed particle size in the toner of 1.2 μm.

Comparative Example 3

| | | |
|---|---|---|
| Binder Resin (1) | 100 | parts by weight |
| Carbon Black "REGAL 330R" (Manufactured by Cabot Corporation) | 8 | parts by weight |
| Charge Control Agent "BONTRON S-34" (Manufactured by Orient Chemical Co., Ltd.) | 0.5 | parts by weight |
| Low-Molecular Weight Polypropylene Wax "VISCOL 550P" (Manufactured by Sanyo Chemical Industries, Ltd.) | 2 | parts by weight |

The starting materials in the above proportions were blended well using a Henschel mixer, and then the mixture was kneaded using a twin-screw extruder. The resulting mixture was cooled and then roughly pulverized, and the roughly pulverized mixture was finely pulverized using a jet mill. Further, the resulting finely pulverized powder was classified using an air classifier, to give an untreated toner having an average particle size of 10 μm.

To 1000 g of the untreated toner, 3 g of a hydrophobic silica "AEROZIL R-972" (manufactured by Nippon Aerozil Ltd.) was added to mix and adhere the hydrophobic silica to the toner surface using a Henschel mixer, to give Comparative Toner 3.

Incidentally, the charge control agent had a dispersed particle size in the toner of 1.8 μm.

Toners prepared in Examples 1 and 2 and Comparative Examples 1 to 3 were subjected to a 2000 sheets continuous printing test by using a testing machine (plain paper facsimile "TF-58HW" manufactured by Toshiba Corporation) employing a nonmagnetic one-component developing method which gives charges to the toners by triboelectric charging with the charging blade, to evaluate printing quality. The results are shown in Table 1.

TABLE 1

| | | At Start | | After 2000 Sheets | |
|---|---|---|---|---|---|
| | Charge Control Agent (Parts by Weight) | Image Density[1)] | Background Level on Photo-conductor[2)] (%) | Image Density[1)] | Background Level on Photo-conductor[2)] (%) |
| Toner 1 | T-77 (0.4) | 1.37 | −1.2 | 1.38 | −1.5 |
| Toner 2 | T-77 (0.6) | 1.38 | −1.5 | 1.36 | −1.6 |
| Comparative Toner 1 | Not added | 1.36 | −5.5 | 1.30 | −6.7 |
| Comparative Toner 2 | T-77 (2.0) | 1.38 | −4.5 | 1.36 | −5.3 |
| Comparative Toner 3 | BONTRON S-34 (0.5) | 1.35 | −2.3 | 1.10 | −9.8 |

Here, the image density was evaluated by using a Macbeth densitometer. The percentage of background level on the photoconductor was obtained by taking out the images formed on the photoconductor using a mending tape, measuring an Y-value using a color and color difference meter "CR-221" (manufactured by Minolta Camera Co., Ltd.), and calculating the percentage from the Y-values of the mending tapes before and after testing.

As is clear from Table 1, the toners of the present invention gave an extremely low background level, showing substantially no increase in the background level or a decrease in image density after conducting continuous printing for 2000 sheets. By contrast, in the case of Comparative Toner 1 where no charge control agent was added and the case of Comparative Toner 2 where 2 parts by weight of the charge control agent were added, the background level was notably increased. In addition, in the case of Comparative Toner 3 where a chromium-based charge control agent "BONTRON S-34" suitably used for two-component developer was used, the charge control agent was transferred to the developer roller, thereby showing increase in the background level and decrease in image density after printing 2000 sheets.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A nonmagnetic one-component toner usable in a developer device comprising a developer roller and a blade, the blade serving to regulate a toner layer formed on the developer roller into a uniform thickness and to supply electric charges to the toner by triboelectric charging, said nonmagnetic one-component toner comprising at least a binder resin, a colorant, and an iron compound, wherein said binder resin comprises a polyester resin as a main component, and wherein said iron compound has the following general formula (I):

(I)

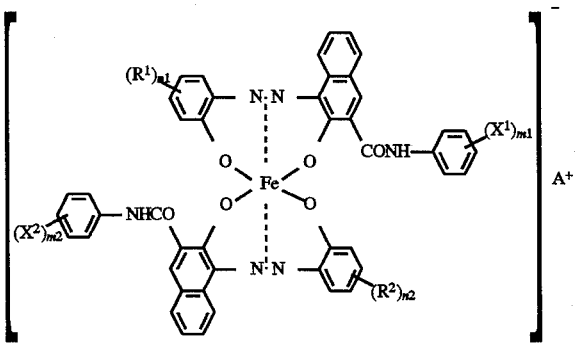

wherein $R^1$ and $R^2$ independently is a hydrogen atom, an alkyl group having 1 to 18 carbon atoms, an alkenyl group having 2 to 18 carbon atoms, a sulfonamide group, a methanesulfonyl group, a sulfonic acid group, a carboxyester group, a hydroxyl group, an alkoxy group having 1 to 18 carbon atoms, an acetylamino group, a benzoylamino group, or a halogen atom, and $R^1$ and $R^2$ may be identical or different; n1 and n2 each stands for an integer of 1 to 3; $X^1$ and $X^2$ independently is a hydrogen atom, an alkyl group having 1 to 18 carbon atoms, an alkoxy group having 1 to 18 carbon atoms, a nitro group, or a halogen atom, and $X^1$ and $X^2$ may be identical or different; m1 and m2 each stands for an integer of 1 to 3; and A is a hydrogen ion, a sodium ion, a potassium ion, an ammonium ion, or mixtures thereof, and is contained in an amount of between 0.1 parts by weight or more and less than 1.0 part by weight, based on 100 parts by weight of the binder resin.

2. The nonmagnetic one-component toner according to claim 1, wherein said polyester resin has an OHV/AV value of 1.2 or more when an acid value is defined as AV and a hydroxyl value is defined as OHV.

3. The nonmagnetic one-component toner according to claim 1, wherein said polyester resin is obtainable by condensation polymerization between:

(a) a diol component represented by the following general formula (II):

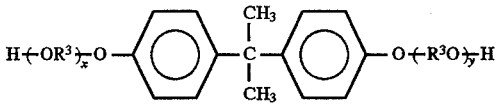

(II)

wherein $R^3$ stands for an alkylene group having 2 to 4 carbon atoms; and x and y independently stand for positive integers with an average sum of 2 to 16; and (b) an acid component comprising:

(i) 1 to 50 mol % of a dicarboxylic acid represented by general formulas (III) or (IV):

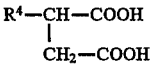

(III)

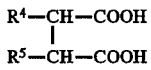

(IV)

wherein $R^4$ and $R^5$ independently is a saturated or unsaturated hydrocarbon group having 4 to 20 carbon atoms, or an acid anhydride thereof; and (ii) 10 to 30 mol % of trimellitic acid or an acid anhydride thereof.

4. The nonmagnetic one-component toner according to claim 1, wherein said polyester resin has a glass transition temperature of 55° C. or more.

5. The nonmagnetic one-component toner according to claim 1, wherein said iron compound having the general formula (I) has a dispersed particle size of 1.0 μm or less.

6. The nonmagnetic one-component toner according to claim 1, wherein said iron compound has the general formula (I), wherein $R^1$ and $R^2$ are both chlorine atoms, n1 and n2 are both equal to 1, $X^1$ and $X^2$ are both hydrogen atoms, and wherein A is a hydrogen ion, a sodium ion, an ammonium ion, or mixtures thereof.

* * * * *